US006193643B1

(12) United States Patent
Larsson

(10) Patent No.: US 6,193,643 B1
(45) Date of Patent: Feb. 27, 2001

(54) DECANTATION CENTRIFUGE WITH PERIPHERAL WASHING NOZZLES

(75) Inventor: Lars-Åke Larsson, Kungsbacka (SE)

(73) Assignee: Noxon AB, Kungsbacka (SE)

( * ) Notice: Subject to any disclaimer, the term of this patent is extended or adjusted under 35 U.S.C. 154(b) by 0 days.

(21) Appl. No.: 09/171,971

(22) PCT Filed: May 2, 1997

(86) PCT No.: PCT/SE97/00742

§ 371 Date: Oct. 29, 1998

§ 102(e) Date: Oct. 29, 1998

(87) PCT Pub. No.: WO97/40941

PCT Pub. Date: Nov. 6, 1997

(30) Foreign Application Priority Data

May 2, 1996 (SE) ..... 9600017

(51) Int. Cl.[7] ..... B04B 11/02; B04B 15/12

(52) U.S. Cl. ..... 494/26; 494/27; 494/28; 494/29; 494/64

(58) Field of Search ..... 494/23, 25, 26, 494/27, 28, 29, 64

(56) References Cited

U.S. PATENT DOCUMENTS 4,190,194 * 2/1980 Amero ..... 494/27
4,654,022 3/1987 Shapiro .
5,426,866 6/1995 Rumocki .

FOREIGN PATENT DOCUMENTS 2349298 4/1975 (DE) .
WO9205877 4/1992 (WO) .

OTHER PUBLICATIONS

International search report dated Sep. 2, 1997.

* cited by examiner

*Primary Examiner*—David A. Reifsnyder
*Assistant Examiner*—Michael A. Fleming
(74) *Attorney, Agent, or Firm*—Marshall, O'Toole, Gerstein, Murray & Borun

(57) ABSTRACT

The invention refers to a decanter centrifuge particularly for sludge centrifugation, incorporating a drum, a rotor arranged therein and equipped with a helical screw for feed of sludge, a sludge outlet and a reject outlet and a flush washing device for washing (flushing) in countercurrent to the dewatered sludge. In the rotor in close connection to the blades of the helical screw are provided a number of threaded holes for connection of the nozzles of the flush washing device. In response to the washing requirement, certain or entire groups of threaded holes are closable by means of sealing plugs, so that the washing (flushing) can be effected in several consecutive steps with portions without flushing in between.

8 Claims, 2 Drawing Sheets

DECANTATION CENTRIFUGE WITH PERIPHERAL WASHING NOZZLES

TECHNICAL FIELD

The present invention refers to a centrifuge particularly for sludge centrifugation, and incorporating an inlet tube with a mixing chamber and a drum having a helical screw for feed of sludge, and with a washing device and sludge and reject outlet.

BACKGROUND OF THE INVENTION

To a large extent decanter centrifuges are used for dewatering sludge from industrial processes and from waste water treatment, where large volumes of sludge are obtained, e,g. after chemical and/or biological precipitation of waste water. The sludge may contain large amounts of chemicals, such as alkalis, particularly within mining and cellulose industries, which should not be retained in the sludge, but which instead should follow the reject and be returned to the process. For final drying and for treatment of the sludge it is required that the maximum content of substances that can be washed out is eliminated by means of washing of the sludge for reduction of the costs in the subsequent treatment.

A decanter centrifuge incorporates a drum with a cylindrical and a conical part. The drum is driven by means of a motor. The rotational speed of the drum is normally about 1.500 to 4.000 rpm. Inside the drum is provided a helical screw, which also is rotatably arranged, either via the drum motor or via a separate motor. The blades of the helical screw hereby form an angle less than 90° against the longitudinal axis of the centrifuge in a direction towards the front end of the centrifuge, which means that the blades of the helical screw are arranged obliquely in the forward transport direction. At rotation of the drum a sludge containing the sludge portion of the water is thrown against the circumference of the drum and its water portion is pressed out of the sludge inwardly towards the centre of the drum. The water thereupon can be eliminated through the reject outlet. By rotating the drum and the helical screw at different rotational speeds a transport effect is obtained thus that the sludge is fed towards one end of the drum, the conical one, for being taken out there. If the drum and the screw have the same rotational speed, no feed is obtained. The helical screw can be individually designed depending on the type of sludge.

Occurring types of sludge are waste water treatment sludge, which has a very heterogenous composition, and on the other hand industrial sludge from e.g. the cellulose industry, where the sludge has a more homogenous composition. In all cases the sludge most often contains water retaining material, such as cellulose fibres, metallic hydroxide flocs and other things. The requirement however is always to obtain such a high final TS-number (content of total solids) as possible and in certain cases to obtain such a clean sludge as possible.

PURPOSE OF THE INVENTION

The purpose of the present invention is to provide a decanter centrifuge which a) washes and/or rinses the dewatered sludge by addition (flushing) of washing liquid or the like, inside the centrifuge in order to remove washable rests in the dewatered sludge, and b) dries the dewatered sludge by addition (blowing) of steam, hot air or the like, inside the centrifuge in order to obtain such a high degree of dryness as possible in the dewatered sludge, c) has so low contents of chemicals residuals and the like as possible in the sludge, and d) has a high degree of dryness.

These tasks have been solved by the features defined in the following claims.

DESCRIPTION OF THE DRAWINGS

Hereinafter the invention will be further described with is reference to the accompanying drawings, which show some embodiments.

DESCRIPTION OF EMBODIMENTS

Figure 1:
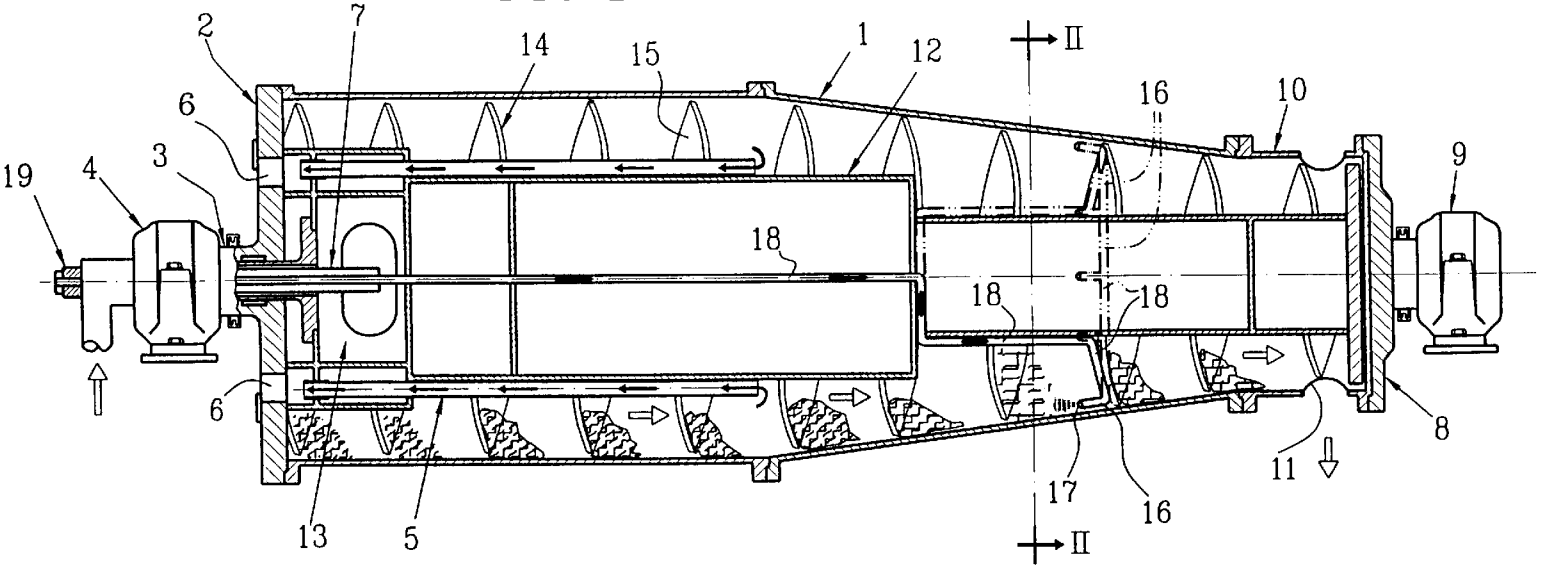
FIG. 1 shows a decanter centrifuge according to the present invention as seen in a longitudinal cross section along its longitudinal axis.
Figure 2:
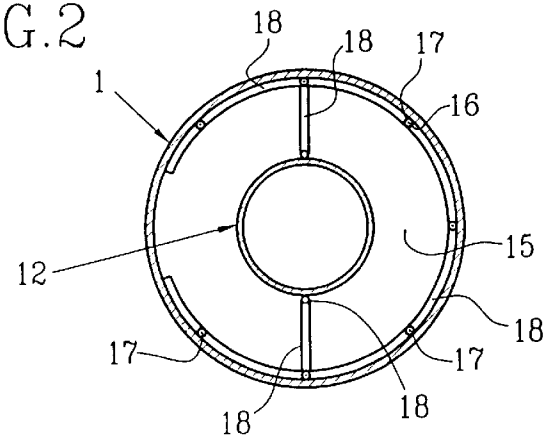
FIG. 2 shows a helical screw blade as seen in a cross section transversally to the longitudinal axis of the centrifuge.
Figure 3:
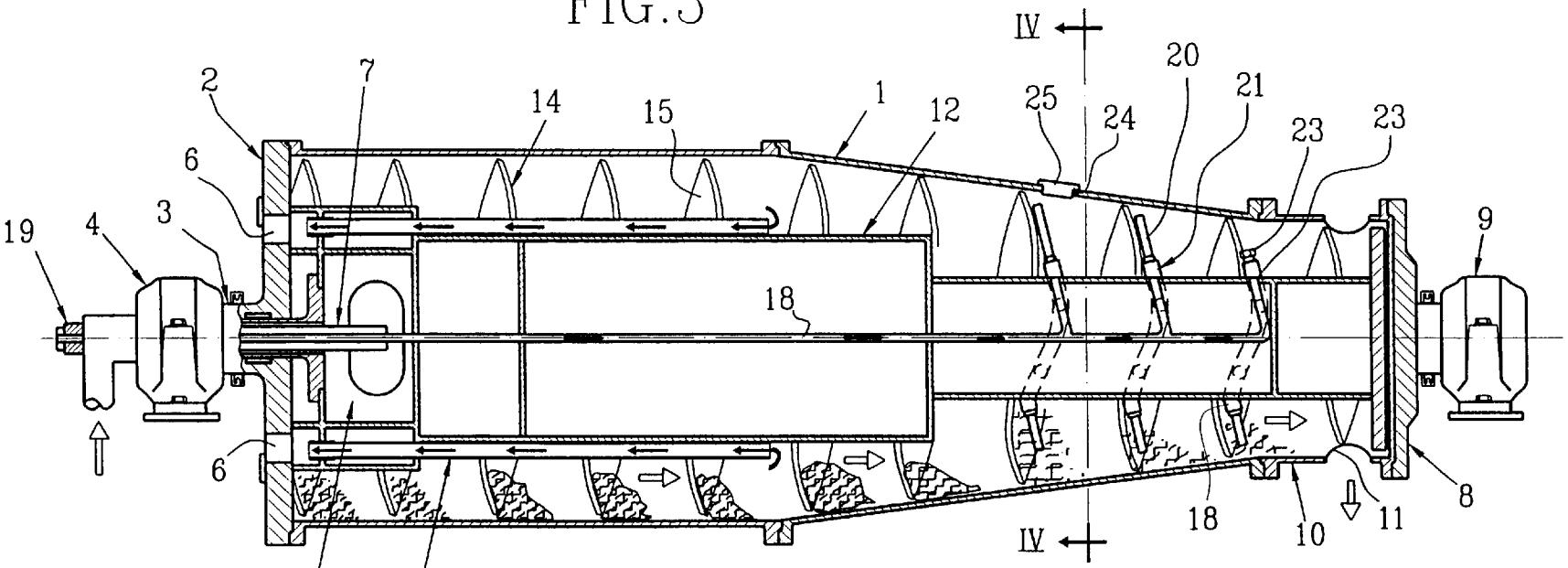
FIG. 3 shows a modified embodiment of the decanter centrifuge according to the present invention as seen in cross section along its longitudinal axis.
Figure 4:
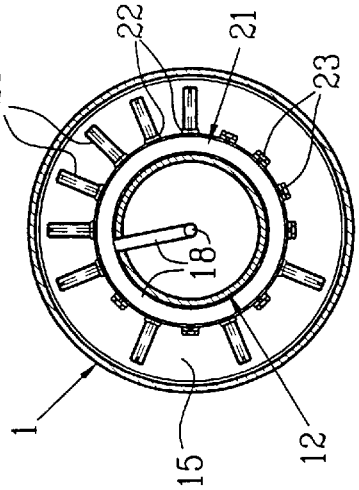
FIG. 4 shows a helical screw blade according to FIG. 3 as seen in a cross section transversally to the longitudinal axis of the centrifuge.

The drum of the decanter centrifuge is designated 1, and which in one of its portions is cylindrical and in its other portion is conically tapering towards a forward, cylindrical end portion 1. The drum 1 is closed off at its cylindrical portion by a back member 2, which incorporates a connection 3 to a bearing housing 4 and passages 6 for reject water. The connection 3 also incorporates a passage for a tube 7 for 5 sludge inlet. At its front end the drum 1 is enclosed by a forward end member 8 provided with a passage for an outgoing shaft to a bearing housing 9. In the forward cylindrical portion 1 of the drum 1 there is a sludge outlet 11. On the outgoing shaft of the bearing housing 9 is mounted an internal rotor 12, which incorporates a mixing chamber 13 connected to the tube 7. Incoming sludge is homogenized in the mixing chamber 13 and any further sludge dewatering chemicals, such as polymers, are added.

On the outer side of the rotor 12 is provided a helical screw 14, the blades 15 of which have a pitch of 60–200 mm depending on the nature of the sludge. On the rear side of the blades 15 is circumferentially provided a flush washing device having nozzles 17, which flush (spray) the washing liquid in countercurrent to the transport direction of the sludge. The washing liquid is supplied via a supply tube 18, which rotates together with the inner screw. The supply of washing liquid to the tube is effected by means of a rotating swivel 19. With this system, washing can be effected either continuously or intermittently by means of a timer-controlled magnetic valve. The washing liquid is discharged through the reject tube 5 together with the other reject water.

The centrifuge operates generally as a conventional decanter centrifuge, whereby sludge with low TS-content is introduced through the tube 7 and is distributed in the drum 1 from the mixing chamber 13, where the heavier constituents of the sludge settle against the interior envelope surface of the drum 1 due to the centrifugal forces, and the liquid, normally water, is pressed out and is collected towards the centre of the drum 1. Due to different rotational speeds between drum and helical screw, the sludge is conveyed toward the front end (in the drawing the right hand end) of the centrifuge, where it is discharged via the openings 11.

The nozzles 17 of the flush washing device 16, which are connected to said supply tube 18, which in turn is connected to the rotating swivel 19 at the inlet end of the centrifuge, can also be utilized for introduction of hot air or steam for further drying of the sludge. Thereby is obtained a much improved cleanliness and dryness respectively in the dewatered sludge.

In order to get the best possible washing out of chemicals from the dewatered sludge it is possible to add the washing liquid also in the sludge phase of the decanter, i.e. so close to the circumference of the drum 1 as possible. This is best done by means of a number of rather long nozzles 20 mounted on the flush washing device 21, which is provided on the structure body of the rotor 12. The flush washing device operates thus, that the washing liquid must pass through the sludge phase on its way to the reject tubes 5 and thereby is obtained an efficient washing of the sludge. The washing liquid is supplied by aid of the said supply tube 18. This device can also be utilized for supply of hot air or steam for further drying of the sludge.

By the present invention is obtained very high cleanliness and dryness respectively in the dewatered sludge.

The rotor 12 is provided with a number of holes having threads 22 for mounting of the nozzles 20 in response to the washing requirement. Where nozzles 20 are not required these holes are closed off by means of sealing plugs 23. If required, the washing, with this system, can be accomplished in two or more steps, i.e. nozzles 20 can be present at the beginning and at the end of the flush washing device with sealing plugs 23 inbetween. For giving opportunity of easy altering the locations of the nozzles 20, the cylindrical drum 1 and the conical portion of the centrifuge are equipped with a number of threaded holes 24 of appropriate size, which during operation can be closed off by means of threaded plugs 25. With this system washing can be effected either continuously or intermittently by means of a time controlled magnetic valve. The washing water is discharged via the reject tubes (5) together with the other reject water.

What is claimed is:

1. A decantation centrifuge comprising:

a drum with a sludge outlet and a reject outlet;

a helical screw blade on a rotor within the drum, the rotor having threaded holes adapted for providing a supply of washing fluid;

sealing plugs adapted for selectively sealing the threaded holes; and at least one washing nozzle with an outlet at an outer portion of the blade, in fluid connection with one of the threaded holes.

2. The centrifuge of claim 1, in which multiple nozzles are disposed on a circumferential pipe that is connected to the threaded holes.

3. The centrifuge of claim 1, in which multiple nozzles are disposed on a circumferential pipe that is connected to the threaded holes by a radial tube.

4. The centrifuge of claim 1, in which the drum has an axis and the nozzle is disposed parallel to the axis.

5. The centrifuge of claim 1, in which the threaded holes are connected to a supply of hot air or steam.

6. The centrifuge of claim 1, in which the nozzle is disposed along a side of the blade.

7. The centrifuge of claim 1, in which the threaded hole is disposed adjacent the base of the blade.

8. A decantation centrifuge comprising:

a drum with a sludge outlet and a reject outlet;

a helical screw blade on a rotor within the drum, the rotor having threaded holes;

a supply of hot air or steam connected to the threaded holes;

sealing plugs adapted for selectively sealing the threaded holes; and at least one washing nozzle with an outlet at an outer portion of the blade, in fluid connection with one of the threaded holes.

* * * * *